US009951476B2

(12) United States Patent
Yin et al.

(10) Patent No.: US 9,951,476 B2
(45) Date of Patent: Apr. 24, 2018

(54) CHEMICAL PULPING METHOD

(71) Applicant: BEIJING INSIGHT BIOMASS LLC, Beijing (CN)

(72) Inventors: Yingwu Yin, Beijing (CN); Peng Wan, Beijing (CN); Honggui Yu, Beijing (CN); Yujuan Zhang, Beijing (CN); Xiangxiang Sun, Beijing (CN); Lingyan Zhang, Beijing (CN)

(73) Assignee: Beijing Insight Biomass LLC, Beijing (CN)

( * ) Notice: Subject to any disclaimer, the term of this patent is extended or adjusted under 35 U.S.C. 154(b) by 19 days.

(21) Appl. No.: 14/411,077

(22) PCT Filed: Jun. 25, 2013

(86) PCT No.: PCT/CN2013/000757
§ 371 (c)(1),
(2) Date: Dec. 23, 2014

(87) PCT Pub. No.: WO2014/000420
PCT Pub. Date: Jan. 3, 2014

(65) Prior Publication Data

US 2015/0176207 A1 Jun. 25, 2015

(30) Foreign Application Priority Data

Jun. 25, 2012 (CN) ..... 2012 1 0209351

(51) Int. Cl.
*D21C 3/02* (2006.01)
*D21H 17/66* (2006.01)

(52) U.S. Cl.
CPC ..... *D21H 17/66* (2013.01); *D21C 3/02* (2013.01)

(58) Field of Classification Search
None
See application file for complete search history.

(56) References Cited

U.S. PATENT DOCUMENTS 2,388,592 A * 11/1945 Asplund et al. ..... 162/23
5,182,161 A * 1/1993 Noda et al. ..... 428/195.1

FOREIGN PATENT DOCUMENTS

| | | | |
|---|---|---|---|
| CN | 1865583 | A | 11/2006 |
| CN | 101899794 | A | 12/2010 |
| CN | 102337687 | A | 2/2012 |
| JP | 50000104 | A | 1/1975 |
| JP | 52090468 | A | 7/1977 |
| JP | 54096102 | A | 7/1979 |
| JP | 2001295188 | A | 10/2001 |
| JP | 2001519486 | A | 10/2001 |
| JP | 4069648 | A | 9/2003 |
| JP | 2004503683 | A | 2/2004 |
| WO | 2007144588 | A1 | 12/2007 |

OTHER PUBLICATIONS

Japanese Office Action, dated Jan. 16, 2017, in Japanese Patent Application No. 2015-518791, a related application with English translation, 7 pp.
Taiwanese Office Action, dated Oct. 14, 2016, in Taiwanese Patent Application No. 10521249830, a related application, 4 pp [relevance can be found in listing of references on p. 4].
Tran, Honghi, and Esa K. Vakkilainnen. "The kraft chemical recovery process." URL: http://www.tappi. Org /content/events/08kros/manuscripts/1-1. pdf [Accessed Aug. 30, 2012] (2008).

* cited by examiner

*Primary Examiner* — Jacob Thomas Minskey
(74) *Attorney, Agent, or Firm* — Lathrop Gage LLP

(57) ABSTRACT

The present invention provides a pulping method. Caustic soda is replaced with cheap lime to manufacture pulp in high efficiency, and meanwhile complexation, flocculation and acid-base neutralization of aluminum sulfate are further utilized, so as to recycle effective ingredients in a black liquid, achieve a yield approximate to a mechanical pulp yield, obtain quality of the chemical pulp, implement cyclic utilization of the black liquid and solve the pollution thereof.

16 Claims, No Drawings

CHEMICAL PULPING METHOD

CROSS-REFERENCE TO RELATED APPLICATIONS

This application is a U.S. National Stage Application filed under 35 U.S.C. § 371 of International Application No. PCT/CN2013/000757, filed Jun. 25, 2013, which claims the benefit of Chinese Application No. 201210209351.4, filed Jun. 25, 2012. Both of these applications are hereby incorporated by reference in their entireties.

TECHNICAL FIELD

The present technique belongs to the field of deep development and application of biomass, which can be widely used in the field of pulping and papermaking, and new materials.

BACKGROUND

Currently, cellulose has been widely used in many fields, and finds papermaking the most important use. Paper is a necessity in national production and life. In 2012, the output of paper and paperboard in China exceeded 100 million tons, accounting for 23.5% of the world's total output and ranking the first in the world. The pulping and papermaking industry is one of the important industries contributing to the national economy of China, and with the advancement of human society, the pulping and papermaking, and new material industries would have great development potential.

At present, pulping and papermaking industry faces a challenge that a large number of small pulp and paper mills are forced to shut down due to large energy consumption and the substandard sewage discharge. Over the years, owing to the multiple restriction factors including environmental protection, raw materials supply and high cost, pulp mills in China are shrinking and have low profit. The annual capacity has been less than 30 million tons, and the main pulp they produced is wood pulp. Moreover, the imported primary pulp and recycled pulp have exceeded 60 million tons. Furthermore, pulping and papermaking industry has become the industry which discharges the most organic water in China, accounting for 30% of total industrial waste water.

Pulping is a production process which separates plant fibrous raw materials into pulp by chemical, mechanical or biological method, or the combinations thereof. According to different cooking and refining processes, chemical pulp, semi-chemical pulp, chemi-mechanical pulp, mechanical pulp and biological pulp with different yield, performance and quality can be produced.

Nowadays, the fiber extraction method widely used in papermaking industry typically refers to soda pulping or kraft pulping. Alkali is present as the most common chemical raw material in chemical and semi-chemical pulping process. As the major component of cooking liquor of wood (or non wood), alkali plays a key role in the removal of lignin and the separation of the key material of papermaking, i.e. fiber from the cells of plant raw materials. In conventional cooking process, in order to ensure the quality and yield of perfect stuff obtained from the raw materials, the amount of caustic soda and sodium sulfide is generally about 25% of that of raw material. Particularly, the currently common kraft pulping process not only consumes a large amount of alkali, but also uses a considerable amount of additives such as sulfide and anthraquinone and the like, resulting in many shortcomings such as low yield, poor quality of fiber pulp, serious "three wastes" problems, difficult after-treatment, large investment, high cost, and high energy consumption. 2 to 3 tons (on 100% purity basis) of plant raw materials and 0.67 to 0.9 tons (on 100% purity basis) of alkali are needed to obtain 1 ton of fiber pulp. The use of large amounts of alkali would cause damage of fiber and lignin, and high consumption of raw materials, which not only increase the cost of pulping, but also cause resource waste and difficulty in the treatment and reutilization of the black liquor. A considerable amount of useful substances such as lignin, soluble cellulose and hemicelluloses contained in the black liquor is not fully utilized but is burned or illegally discharged. Nowadays, incineration is considered to be a viable solution to the pollution of black liquor in papermaking. The existing large pulp mills recycle and reutilize alkalis by concentrating, incinerating and causticizing method, which partially solve the problem of the pollution of black liquor, but consume a lot of biomass resources, and cause problems such as high equipment investment, high cost, large energy consumption, the generation of a large amount of waste gas containing carbon dioxide, nitrogen oxides, sulfur dioxide, dioxin and other waste gas, washing waste water containing a lot of lignin, dissolved cellulose, hemicellulose, protein and the like, and the waste residue entraining a lot of lime mud dominated by calcium carbonate such as residual soda, sodium sulfide, aluminosilicate, leading to serious secondary pollution. The black liquor which contains a large amount of silicate, such as straw black liquor, has an unsatisfactory effect of operation due to easy of being concentrated and scaled. Moreover, the whole system of concentration and incineration of black liquor has the following disadvantageous including high investment (accounting for more than half of the total investment), high cost and great energy consumption. At present, the lignin generated by alkaline pulping process throughout China is about 20 million tons per year, with almost all being incinerated or discharged, and only a portion being utilized in terms of heat energy.

Mechanical pulp, mainly produced by mechanical grinding process, contains higher lignin and other components of cells. Such process has advantages of simple production process, low cost, high yield, little pollution, excellent printability, good smoothness, good opacity of the finished paper, etc., but has disadvantages of serious fiber fracture in grinding, small aspect ratio, complex pulp composition, poor effect of fibrillation and poor properties of finished paper. The mechanical pulp is mainly obtained by mechanical grinding process, which is merely suitable for using wood as raw material. Thus, such process has the problems including high energy consumption (consumed more than 1000 kilowatt-hours of electricity per ton of pulp), single raw material, less wood raw material, high price, "put fine timber to petty use", etc., and the problems of high equipment investment, high frequency of downtime maintenance and large repair cost.

Chemi-mechanical pulp is obtained by separating fibrous raw materials via chemical, thermal, or mechanical process or combinations thereof. Due to the delignification of the chemical substances such as alkalis, the defibration point mainly occurs in the intercellular layer, and the chemi-mechanical pulp has a large content of long fiber and a small content of fine fiber, a large content of lignin and a high optical scattering coefficient. The chemi-mechanical pulp, as a supplement of pulp, has certain potential of development and application in pulping industry in terms of the effective utilization of the waste material in the processing of wood.

Biopulping is one trend of clean pulping process. However, since the requirements for the cultivation and selection of biological strains and the conditions for the pulping process are high, there are many problems such as large fluctuation in production, hard permeation, non-uniform treatment of the materials, long processing time, poor quality of the and low production efficiency. Through more than ten years' study, only certain pulp manufacturers in China are producing low quality pulp from straw and for the cost of processing per ton, only hundreds of Chinese yuan is saved. Thus the method still needs further development.

After years of exploration and research on full development of plants, the inventors have developed a sectionalized green technology which can efficiently extract fibers from fibrous raw materials with high yield, and a whole set of technology which can directly utilize or extract lignin and prepare organic potash fertilizer from black liquor. The technologies have broken through the key technical bottleneck of both green technology and ecological industry, and realized the full development of plants. Meanwhile, the prior art process also develops a pulping process utilizing lime directly.

The present invention relates to a chemical pulping process, which is developed exactly based on the above. This process inherits the technical characteristics of the ancient papermaking technique, one of the four great inventions of ancient China, and combines our earlier research findings of alkali pulping. Such process not only greatly enhances the efficiency of pulping, but also achieves a pulp yield approximate to that of mechanical pulp, while minimizing fiber fracture to the largest extent and maintaining fiber strength as well.

DETAILED DESCRIPTION OF THE INVENTION

Through long-term experiment, the inventors find a reaction of producing calcium sulfate precipitation with low solubility from sulfate and calcium ion. By adding lime into the aqueous filtrate obtained by filtering out insoluble substances from the fiber slurry or into the previous batch of filtrate obtained by treating with aluminum sulfate, and then filtering out insoluble substances, the reaction can precipitate the sodium sulfate or potassium sulfate that dissolved in the filtrate as calcium sulfate and produce sodium hydroxide or potassium hydroxide. In the process, the concentration of free hydroxide radical is 3.5 times higher as compared with adding calcium hydroxide alone. Heating could promote alkali to spread towards the plant body and meanwhile to consume continuously, during which calcium ions are continuously precipitated by sulfate radical. The precipitation of calcium ions can effectively promote the continuous dissolution of calcium hydroxide and the release of hydroxide radical. The hydroxide radicals spread quickly and are neutralized by acidic substances such as lignin, which promotes the shift of the equilibrium, and further, realizes the purpose of replacing strong alkalis with weak alkalis, i.e. replacing NaOH or KOH with cheap lime, and producing pulp with high efficiency and quality without black liquor through the reutilization of the pulping liquor. The experiment shows that, as compared with the cooking experiment using calcium hydroxide alone, the process not only largely shortens the time of soaking and cooking, but also significantly increases the yield and quality of fiber. The thus obtained fiber has similar properties to that prepared by the existing alkaline and kraft process, which proves the feasibility of the clean pulping process that uses a combination of lime and sulfate instead of alkalis.

With further study, it is found that aluminum sulfate can be added into the above-mentioned pulping black liquor or the mixture of black liquor and fibers obtained after the completion of the cooking of the existing kraft and alkaline pulping processes, to further utilize the effective ingredients such as lignin in the black liquor. After beating and refining of the pulping process, the effective ingredients such as lignin could be uniformly adsorbed on the surface of fibers to form a fiber pulp. In this end, not only a yield approximate to that of mechanical pulp can be achieved, but also the quality and strength of chemical pulp can be maintained; and on the other hand, not only the effective ingredients in the black liquor can be reutilized, but also the pollution of the black liquor can be eliminated.

Aluminum sulfate per se is an inorganic additive used in combination with AKD or rosin in papermaking, and can improve the water-proofing properties of paper products well, since aluminum sulfate not only makes paper more hydrophobic, but also improves the density and strength of paper. Aluminum sulfate and the black liquor with a pH of 9-10 could easily flocculate into polymers, during which the lignin in the black liquor precipitate as aluminum salt of lignin. Therein, aluminum ions may function as "triangle rivet" and form a mesh structure with plant ingredients such as lignin, thereby improving the strength of the paper products, and the hydrophobicity of the lignin enhances the same of the paper products.

By virtue of the flocculation of aluminum sulfate, most of the organic compounds can be adsorbed on the surface of the fibers, such that the single removal rate of COD of the black liquor is up to above 60%, and the soluble sulfate and other residues remain in the solution. The composite alkali according to the present invention refers to the mixture containing lime and/or carbide slag and sulfate or sulfate-containing solution; the sulfate is preferably water soluble sodium sulfate and/or potassium sulfate. Therein, the sulfate-containing solution is preferably a sulfate-containing filtrate obtained by precipitating organic macromolecules of the black liquor through aluminum sulfate and then filtering out the insoluble substances.

Through experiments, it is found that the organic compounds such as lignin, which are absorbed on the surface of fiber through action of, for example, bridging, complexation and flocculation of aluminum sulfate, not only increase the hydrophobicity and the mutual adhesion of the fiber, making the produced calcium sulfate and fiber co-precipitate well to produce inorganic-organic composite material with good performance, but also realize the reutilization of the black liquor produced in pulping, and make it possible to produce fiber pulp in a large scale, with low cost and without black liquor produced. The present invention can be widely used in fields of papermaking, fibrous composite, controlled-release materials for fertilizer, fire retardant and other new materials.

It is one aspect of the invention to provide a pulping process, including:

1) cooking the plant raw materials using the composite alkali containing sulfate and lime and/or carbide slag, to prepare a fiber pulp containing fibers and black liquor;

2) optionally, after the completion of cooking and/or during pulping process, adding aluminum sulfate to the pulp, to flocculate and settle the organic macromolecules of the black liquor and adsorb the same on the fibers, and then separating them out; and/or 3) optionally, adding plant raw materials and alkali used in the existing alkaline process, or other weak alkalis such as lime and/or carbide slago and the like to the sulfate-containing filtrate which is obtained by filtering out the insoluble substances of the pulp, to prepare a fiber pulp;

wherein steps 2) and 3) are optionally carried out.

In one embodiment, the pulping process according to the present invention comprises step 1).

In another embodiment, the pulping process according to the present invention comprises steps 1) and 2), or steps 1) and 3).

In a further embodiment, the pulping process according to the present invention comprises steps 1), 2) and 3).

It is another aspect of the invention to provide a pulping process, including:

1) cooking the plant raw materials using the existing alkaline or kraft process, to prepare a fiber pulp containing fibers and black liquor; and 2) after the completion of cooking and/or during pulping process, adding aluminum sulfate to the pulp, to flocculate and settle the organic macromolecules of the black liquor and adsorb the same on the fibers, and then separating them out; and/or 3) optionally, adding plant raw materials, sulfate and the alkali used in the existing alkaline process, or the composite alkali containing sulfate and lime and/or carbide slag to the filtrate which is obtained by filtering out the insoluble substances of the pulp, to prepare a fiber pulp.

In one embodiment, the pulping process according to the present invention comprises steps 1) and 2), or steps 1) and 3).

In another embodiment, the pulping process according to the present invention comprises steps 1), 2) and 3).

In one embodiment, the pulping process according to the present invention comprises the following steps:

1) cooking the fibrous raw materials using the composite alkali containing sulfate and lime and/or carbide slag or using the existing alkaline or kraft process;

preferably, the total weight of the added composite alkali is above 2% according to different requirements for quality;

the conditions for pulping using composite alkali include soaking the plant raw materials and composite alkali for 1 to 100 h at room temperature or under heating condition, and then cooking the resulting product for 1 to 10 h at a temperature in a range from 100 to 165° C., preferably cooking the resulting product for 1 to 12 hours at a temperature in a range from 80 to 130° C., and then cooking the same for 1 to 4 h at a temperature in a range from 120 to 165° C.;

2) after the completion of cooking and/or during pulping process, adding aluminum sulfate to the resulting mixture of fiber and black liquor, to flocculate and settle the organic macromolecules of the black liquor and adsorb the same on the fibers;

3) filtering and separating the above-mentioned mixture of pulp and black liquor to obtain the composite fibrous pulp product, with the organic substance that is not settled or dissolved in water remaining in the filtrate;

4) regenerating alkali: adding weak alkalis such as lime or calcium carbide slag and the like into the above-mentioned filtrate or the aqueous solution of sulfate, i.e. preparing composite alkali, and pulping cooking the same, and after the completion of the cooking, adding aluminum sulfate to separate out fibers and most of lignin solid, and utilizing the final filtrate to cook the next batch of materials.

Preferably, the filtrate is reutilized until it cannot be utilized, or not reutilized, i.e. the filtrate is not precipitated using aluminum sulfate and finds use, among others, as biological nutrient source.

In the present invention, the plant raw materials are wood, bamboo, stalks of plants, such as stalks of crops including wheat, rice, corn, soybeans, sorghum or cotton, Chinese alpine rush, bagasse, reed, or coconut shell.

The alkali used in the existing alkaline process as mentioned in the invention may be one or more selected from the group consisting of aqueous solutions of sodium hydroxide, potassium hydroxide, lime and carbide slag.

Aluminum sulfate can be added after the completion of cooking or during the process of spraying, kneading, shoving or refining before the separation of the perfect stuff.

The aluminum sulfate can be added by adding aluminum sulfate solution or directly adding aluminum sulfate solid.

Aluminum sulfate is added in an amount of 0.5 to 50% based on the weight of fiber, and is preferably added in an amount such that the pH of the solution would not exceed 7.

The aluminum sulfate can be added at a temperature in a range from normal temperature to 100° C.

During the reutilization of the filtrate, the weak alkalis added into the filtrate can be chemical substances such as lime and/or carbide slag and the like which could generate precipitation after reacting with sulfate radicals, wherein the addition amount of the lime and/or carbide slag, calculated as calcium hydroxide, is above 2%, preferably 5% to 15%, based on the weight of the absolute dry plant raw materials (i.e. after the removal of water therein).

During the reutilization of the filtrate, sulfate can be replenished according to the content of the sulfate radicals in the filtrate, to ensure that the alkali produced in the reaction meets the amount of alkali required in cooking.

Advantageous Effects

The process according to the present invention has the following advantages:

1. By virtue of the precipitation characteristic of aluminum sulfate, the process recycles the lignin, hemicellulose and soluble fiber in the black liquor and directly absorbs the same on the fiber as a portion of the slurry, thereby ensuring a yield approximate to that of mechanical pulp, and a fiber quality and paper strength of the chemical pulp. The process not only keeps fiber quality, but also improves the fiber yield, which is up to 86.5% or more.

2. The process uses two chemical equilibriums, i.e. using sulfate and weak alkalis to prepare the strong alkalis required in cooking, and using cheap lime in replace of expensive NaOH and KOH.

3. The present patent can achieve water circulation of pulping process and zero discharge of sewage, and the operation thereof is simple.

BEST MODE FOR CARRYING OUT THE INVENTION

The present invention will be further illustrated by using the following examples, but the scope of the present invention is not limited thereto.

Example 1

Comparative Experiment 431 g of bamboo having a moisture content of 42% by weight, 25 g of NaOH and 895 g of water were added into a cooker. After soaked at 105° C. for 90 min, the mixture was heated to 125° C. and cooked for 150 min at this temperature. After the completion of cooking, the resulting mixture was solid-liquid separated, and then the cooked bamboo was subjected to beating, screening and papermaking, thereby resulting in a pulp yield of 69.5%, with a SR° of 40, and producing papers having a paper basis weight of 80 g, a determined whiteness of 22.7, a burst index of 3.26 kPa·m$^2$/g, a fold number of 51 times, a tensile index of 28.3 N·m/g, a tear index of 17.2 mN·m$^2$/g, a COD of black liquor of 83900, a solid content of 8.5% by weight, and a pH value of 10.46.

Example 2

Experiment on the Effect of Treating Black Liquor with Aluminum Sulfate 431 g of bamboo with a moisture content of 42% by weight, 25 g of NaOH and 495 g of water were added into a cooker. After soaked at 105° C. for 90 min, the mixture was heated to 125° C. and cooked for 150 min at this temperature. After the completion of cooking, the resulting mixture was added to a beater for beating, during which 14 kg of water and 8.8 g of aluminum sulfate were added for flocculation and adsorption. The resulting mixture was then filtered to produce the pulp with organic substances such as lignin being absorbed on, thereby resulting in a pulp yield of 74.7%, with a SR° of 40, and producing papers having a basis weight of 80 g, a determined whiteness of 21.8, a burst index of 3.60 kPa·m$^2$/g, a fold number of 55 times, a tensile index of 29.2 N·m/g, a tear index of 19.0 mN·m$^2$/g, a COD of black liquor of 72300, a solid content of 7.8% by weight, and a pH value of 7.20.

Example 3

Experiment on the Effect of Reutilizing Filtrate and Cooking with Composite Alkali Into 250 g of bamboo (on 100% purity basis), 975 g of a filtrate (with a COD of 2750) obtained by dilution of the black liquor which was treated with aluminum sulfate, 25.0 g of calcium hydroxide and 44.8 g of extra sodium sulfate were added, such that sulfate radicals have the same molar weight as calcium ions, and meanwhile, the solution has a pH of 13.32, in which the concentration of hydroxide radicals increases by 3.2 times as compared with that of the saturated calcium hydroxide with a pH of 12.82. Then the resulting mixture was soaked at 95° C. for 12 h, and blew after cooked for 3.5 h at 165° C. The obtained fiber was subjected to beating and papermaking, thereby resulting in a pulp yield of 83.5%, with a beating degree SR° of 40, and producing papers having a basis weight of 80 g, a determined kappa number of 163, a whiteness of 20.6, a burst index of 2.45 kPa·m$^2$/g, a fold number of 64 times, a tensile index of 29.0 N·m/g, a tear index of 14.2 mN·m$^2$/g, a COD of black liquor of 60100, and a pH value of 9.94.

Example 4

Experiment on the Effect of Recycling the Cooking Liquor with Composite Alkali

Into 250 g of bamboo (on 100% purity basis), 933 g of a filtrate (with a COD of 25200) obtained by addition of 26.6 g of aluminum sulfate to the above black liquor which was treated with calcium hydroxide, and 25.0 g of calcium hydroxide were added. Then the resulting mixture was soaked at 95° C. for 12 h, and blew after cooking at 165° C. for 3.5 h. The obtained fiber was subjected to beating and papermaking, thereby resulting in a pulp yield of 85.0%, with a beating degree SR° of 40, and producing papers having a basis weight of 80 g, a determined Kappa number of 164, a whiteness of 19.6, a burst index of 2.39 kPa·m$^2$/g, a fold number of 54 times, a tensile index of 26.9 N·m/g, a tear index of 15.1 mN·m$^2$/g, a COD of black liquor of 80400, and a pH value of 9.82.

Example 5

Experiment on the Effect of the Composite Alkali

Into 250 g of bamboo (on 100% purity basis), 1033 g of water, 25.0 g of calcium hydroxide, and 47.9 g of sodium sulfate were added. Then the resulting mixture was soaked at 95° C. for 12 h, and blew after cooking at 165° C. for 3.5 h. The obtained fiber was subjected to beating and papermaking, thereby resulting in a pulp yield of 84.4%, with a beating degree SR° of 40, and producing papers having a basis weight of 80 g, a determined Kappa number of 159, a whiteness of 19.9, a burst index of 2.41 kPa·m$^2$/g, a fold number of 50 times, a tensile index of 27.3 N·m/g, a tear index of 16.2 mN·m$^2$/g, a COD of black liquor of 63500, and a pH value of 10.05.

Example 6

Experiment on the Effect of the Precipitation of the Wood Black Liquor Treated with Strong Alkali 500 g of pine (on 100% purity basis) was soaked in NaOH solution (consisting of 100 g of NaOH and 2000 ml of water) at 60° C. for 12 h. The pulp was subjected to beating after being cooked at 165° C. for 3.5 h. 38.5 g of aluminum sulfate was added to the beater for flocculation and adsorption. The resulting mixture was then washed and filtered, thereby resulting in a fiber yield of 75.6%. Papermaking was carried out after dissociating the thus obtained pulp with a standard fiber dissociator, thereby producing papers having a paper basis weight of 80 g, a determined whiteness of 23.0, a burst index of 2.9 kPa·m$^2$/g, a fold number of 56 times, a tensile index of 45.8 N·m/g, and a tear index of 15.2 mN·m$^2$/g.

Example 7

I. Production Comparative Experiment

Into a 25 m$^3$ rotary spherical digester, 5.8 tons of bamboo (on 100% purity basis), 24 bags of NaOH (600 kg, on 100% purity basis) and 10 m$^3$ of water were added. The mixture was then heated to 105° C. and maintained at this temperature for 1.5 h and then was heated to 125° C. and maintained for another 2.5 h. The obtained pulp was blew using air, thereby resulting in a pulp yield of 67%, a COD of black liquor of 112800 ppm, a solid content of 11.7% by weight, a pH value of 10.37. Then the blown pulp was beat and washed, with a SR° of 40. Then, papermaking was carried out after dissociating the thus obtained pulp with a standard fiber dissociator, to produce papers having a paper basis weight of 80 g, a determined whiteness of 22.8, a burst index of 3.15 kPa·m$^2$/g, a fold number of 46 times, a tensile index of 32.3 N·m/g, and tear index of 16.8 mN·m$^2$/g.

Example 8

II Production Experiment of Adding Aluminum Sulfate

In accordance with the conditions of the comparative experiment, 5.8 tons of bamboo (on 100% purity basis), 24 bags of NaOH (600 kg, on 100% purity basis) and 10 m$^3$ of water were added into a 25 m$^3$ rotary spherical digester. The mixture was then heated to 105° C. and maintained at the temperature for 1.5 h and then was heated to 165° C. and maintained at the temperature for another 3.5 h. Into the rotary spherical digester, 0.78 tons of aluminum sulfate solution having concentration of 40% was added for flocculation and adsorption, and then the pulp was blew and knead to obtain 8 m$^3$ of black liquor with a COD of 83300 ppm, thereby resulting in a pulp yield of 73.9%, a solid content of 8.28% by weight, a pH value of 7.26, and a $SO_4^{-2}$ content of 1.60%. The blown pulp was then beat and washed, with a SR° of 40. Then, papermaking was carried out after dissociating the thus obtained pulp with a standard fiber dissociator, to produce papers having a paper basis weight of 80 g, a determined whiteness of 22.3, a burst index of 3.18 kPa·m$^2$/g, a fold number of 42 times, a tensile index of 29.8 N·m/g, and a tear index of 17.4 mN·m$^2$/g.

Example 9

Production Experiment of Cooking Bamboo Raw Material by Reutilizing Composite Alkali-Filtrate 850 kg of sodium sulfate, 550 kg of lime and 2 m$^3$ of water were added into 8 m$^3$ of filtrate obtained in example 8, and the resulting mixture was mixed homogeneously. Then the homogeneous mixture is pumped into a 25 m$^3$ rotary spherical digester with 5.8 tons of bamboo (on 100% purity basis) being added. The mixture was then heated to 105° C. and maintained at the temperature for 1.5 h and then heated to 165° C. and maintained at the temperature for another 3.5 h. 0.78 tons of aluminum sulfate solution having concentration of 40% was added into the rotary spherical digester for flocculation and adsorption, and then the pulp was blew and knead to obtain 8.1 m$^3$ of black liquor with a COD of 81900 ppm, thereby resulting in a pulp yield was 79.4%, a solid content of 7.78% by weight, a pH value of 7.36, and a $SO_4^{-2}$ content of 1.80%. The blown pulp was then beat and washed, with a SR° of 40. Then, papermaking was carried out after dissociating the thus obtained pulp with a standard fiber dissociator, to produce papers having a paper basis weight of 80 g, a determined whiteness of 22.1, a burst index of 2.43 kPa·m$^2$/g, a fold number of 38 times, a tensile index of 27.5 N·m/g, and a tear index of 15.8 mN·m$^2$/g.

Example 10

Production Experiment of Cooking and Precipitating Wood Raw Material 500 g of pine(on 100% purity basis) was soaked in NaOH solution (consisting of 100 g of NaOH and 2000 ml of water) at 60° C. for 12 h. The pulp was subjected to beating after being cooked at 165° C. for 3.5 h. 38.5 g of aluminum sulfate was added to the beater for flocculation and adsorption. The resulting mixture was then washed and filtered, thereby resulting in a fiber yield of 75.6%. Papermaking was carried out after dissociating the thus obtained pulp with a standard fiber dissociator, thereby producing papers having a paper basis weight of 80 g, a determined whiteness of 23.0, a burst index of 2.9 kPa·m$^2$/g, a fold number of 56 times, a tensile index of 45.8 N·m/g, and a tear index of 15.2 mN·m$^2$/g.

The invention claimed is:

1. A pulping process, including:

1) cooking plant raw materials using a composite alkali containing sulfate, and one or more of lime and carbide slag, to prepare a mixture containing fibers and black liquor;

2) after the completion of cooking and/or during pulping process, adding aluminum sulfate to the mixture, to flocculate and settle organic macromolecules of the black liquor and adsorb the same on the fibers, and then separating the fibers from the black liquor; and 3) adding plant raw materials and one or more of alkali used in an alkaline process, lime, and carbide slag, to a sulfate-containing filtrate which is obtained by filtering out insoluble substances of the mixture, to prepare a fiber pulp, wherein the addition amount of aluminum sulfate is 0.5 to 50% based on the weight of fiber; and when adding lime and/or carbide slag in step 3), the addition amount of the lime and/or carbide slag, calculated as calcium hydroxide, is 5% to 15%, based on the weight of the plant raw materials of step 3) in absolute dry conditions.

2. The process according to claim 1 wherein the alkali used in the alkaline process is one or more selected from the group consisting of aqueous solutions of sodium hydroxide, potassium hydroxide, lime and carbide slag.

3. The process according to claim 1, wherein the sulfate in the composite alkali is soluble sodium sulfate or potassium sulfate.

4. The process according to claim 1, wherein the conditions for pulping using composite alkali in step 1) or 3) include soaking the plant raw materials and composite alkali for 1 to 100 h at room temperature or under heating condition, and then cooking the resulting product for 1 to 10 h at a temperature in a range from 100 to 165° C.

5. The process according to claim 1, wherein aluminum sulfate is added after the completion of cooking and/or during the process of spraying, kneading, shoving and/or refining before the separation of the perfect stuff; and/or the aluminum sulfate is added at a temperature in a range from normal temperature to 100° C.

6. The process according to claim 1, wherein the plant raw materials are wood, bamboo, stalks of plants, Chinese alpine rush, bagasse, reed, and/or coconut shell.

7. The process according to claim 1, wherein the mixture is prepared using plant raw materials in the absence of strong alkalis and the black liquor is further reutilized, wherein the strong alkalis are sodium hydroxide or potassium hydroxide.

8. The process according to claim 1, wherein the conditions for pulping using composite alkali in step 1) or 3) include cooking the plant raw materials and composite alkali for 1 to 12 hours at a temperature in a range from 80 to 130° C., and then cooking the resulting product for 1 to 4 h at a temperature in a range from 120 to 165° C.

9. A pulping process, including:

1) cooking plant raw materials using an alkaline or kraft process, to prepare a mixture containing fibers and black liquor;

2) after the completion of cooking and/or during pulping process, adding aluminum sulfate to the mixture, to flocculate and settle organic macromolecules of the black liquor and adsorb the same on the fibers, and then separating the fibers from the black liquor; and 3) adding plant raw materials, sulfate and one or more of alkali used in the alkaline process and a composite alkali, to a filtrate which is obtained by filtering out insoluble substances to prepare a fiber pulp, the composite alkali containing sulfate, and one or more of lime and carbide slag;

wherein the addition amount of aluminum sulfate is 0.5 to 50% based on the weight of fiber; and when adding lime and/or carbide slag in step 3), the addition amount of the lime and/or carbide slag, calculated as calcium hydroxide, is 5% to 15%, based on the weight of the plant raw materials of step 3) in absolute dry conditions.

10. The process according to claim 9, wherein the alkali used in the alkaline process is one or more selected from the group consisting of aqueous solutions of sodium hydroxide, potassium hydroxide, lime and carbide slag.

11. The process according to claim 9, wherein the sulfate in the composite alkali is soluble sodium sulfate or potassium sulfate.

12. The process according to claim 9, wherein the conditions for pulping using composite alkali in step 1) or 3) include soaking the plant raw materials and composite alkali for 1 to 100 h at room temperature or under heating condition, and then cooking the resulting product for 1 to 10 h at a temperature in a range from 100 to 165° C.

13. The process according to claim 9, wherein the conditions for pulping using composite alkali in step 1) or 3) include cooking the plant raw materials and composite alkali for 1 to 12 hours at a temperature in a range from 80 to 130° C., and then cooking the resulting product for 1 to 4 h at a temperature in a range from 120 to 165° C.

14. The process according to claim 9, wherein aluminum sulfate is added after the completion of cooking and/or during the process of spraying, kneading, shoving and/or refining before the separation of the perfect stuff; and/or the aluminum sulfate is added at a temperature in a range from normal temperature to 100° C.

15. The process according to claim 9, wherein the plant raw materials are wood, bamboo, stalks of plants, Chinese alpine rush, bagasse, reed, and/or coconut shell.

16. The process according to claim 9, wherein the mixture is prepared using plant raw materials in the absence of strong alkalis and the black liquor is further reutilized, wherein the strong alkalis are sodium hydroxide or potassium hydroxide.

* * * * *